US007186021B1

(12) United States Patent
Breham et al.

(10) Patent No.: US 7,186,021 B1
(45) Date of Patent: Mar. 6, 2007

(54) METHOD AND SYSTEM FOR CONTROLLING TEMPERATURES IN AN X-RAY IMAGING ENVIRONMENT

(75) Inventors: Sebastien David Breham, Salt Lake City, UT (US); Gregory Alan Weaver, South Hordan, UT (US); David Ellis Barker, Salt Lake City, UT (US); Lonnie B. Weston, Syracuse, UT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/301,843

(22) Filed: Dec. 13, 2005

(51) Int. Cl.
*H01J 35/10* (2006.01)

(52) U.S. Cl. ..... 378/199; 378/200

(58) Field of Classification Search ..... 378/199, 378/200, 141
See application file for complete search history.

(56) References Cited

U.S. PATENT DOCUMENTS 6,320,936 B1 * 11/2001 Holland et al. ..... 378/140
6,519,317 B2 * 2/2003 Richardson et al. ..... 378/130
6,669,366 B2 * 12/2003 Busse et al. ..... 378/199

* cited by examiner

*Primary Examiner*—Edward J. Glick
*Assistant Examiner*—Irakli Kiknadze
(74) *Attorney, Agent, or Firm*—McAndrews, Held & Malloy, Ltd.; Peter J. Vogel; Michael A. Dellapenna

(57) ABSTRACT

Certain embodiments of the present invention provide a system for controlling temperatures in an x-ray imaging environment including: a first component capable of operating within a first temperature range; a second component capable of operating within a second temperature range; and a liquid-based temperature control system capable of maintaining the first component within the first temperature range and maintaining the second component within the second temperature range. In an embodiment, the first component includes an x-ray detector. In an embodiment, the second component includes an x-ray source. In an embodiment, a liquid in the liquid-based temperature control system flows through the first component before flowing through the second component. In an embodiment, a heat exchanger in the liquid-based temperature control system can regulate a temperature of a liquid in the liquid-based temperature control system. In an embodiment, the heat exchanger includes at least one thermoelectric cooler device.

23 Claims, 7 Drawing Sheets

METHOD AND SYSTEM FOR CONTROLLING TEMPERATURES IN AN X-RAY IMAGING ENVIRONMENT

BACKGROUND OF THE INVENTION

Embodiments of the present application relate generally to temperature control in an x-ray imaging system. Particularly, certain embodiments relate to controlling temperatures in both the x-ray source and in the x-ray detector in a mobile x-ray imaging system.

X-ray imaging systems may include temperature-sensitive components, such as an x-ray source and an x-ray detector. Temperature-sensitive components may perform more efficiently when the temperatures of the components are controlled. An x-ray source, for example, may heat up during operation. An x-ray tube may only convert a fraction of energy into x-rays. For example, an x-ray tube may only convert 1% of input energy into x-rays, and the remaining 99% of energy may be converted into heat. For example, if an x-ray tube draws 450 W of power, the tube may generate 446 W of thermal energy.

At a certain temperature, the x-ray tube may lose efficiency, or the generated heat may be relatively difficult to contain given that the system may be intended for use in proximity to human beings. For example, an x-ray tube may incorporate a fluid (e.g. oil) in a housing (e.g. aluminum housing). If the fluid temperature rises to or above a certain temperature (e.g. 90 C), the fluid may become overly expansive. For example, the fluid may expand and destroy a housing, such as an aluminum housing, over a certain temperature. Therefore, it may be desirable to prevent the x-ray source from exceeding a maximum recommended operating temperature. Additional cooling systems may be required to prevent overheating of an x-ray tube, while still allowing system operation.

X-ray detectors, such as solid-state x-ray detectors, may also require temperature control for efficient operation. For example, solid-state x-ray detectors may contain relatively sensitive components. The performance of some solid-state components may be most efficient within a given temperature range. If temperatures exceed a recommended range, the performance of the components may deteriorate. For example, the signal-to-noise ratio of certain sensitive components may decrease when the temperature exceeds a preferred operating range. Furthermore, the detector may be calibrated for efficient performance around a particular temperature (e.g. 30 C). If the detector temperature strays to far from the calibration temperature (e.g. +/−5 C from the calibration temperature), the performance of the detector may become noticeably less efficient. Consequently, it may be desirable to maintain an x-ray detector, such as a solid-state x-ray detector, within a recommended temperature range.

Using fans to dissipate heat in an x-ray source and/or x-ray detector may introduce undesirable effects. For example, air cooling an x-ray source may require a relatively large airflow across the x-ray source. A fan capable of creating such an airflow may also cause undesirable turbulence and airflow in a clinical environment.

Instead, liquid-based temperature control systems may provide certain advantages, especially as applied to x-ray imaging systems in clinical environments. For example, liquid-based temperature control systems may not generate undesired airflow in a substantially sterile environment. Additionally, it may be possible to design liquid-based systems without a pump or other moving part close to a patient. Furthermore liquid-based systems may provide relatively good subcooling capacity for a given volume ratio. Nonetheless, liquid-based temperature control systems may be more expensive than air-based systems. Thus, providing a separate temperature control system for each temperature sensitive component (e.g. a separate system for both the x-ray source and the x-ray detector) may add substantial cost to an x-ray imaging system.

Thus, there is a need for methods and systems that control temperatures in a plurality of temperature-sensitive components in an x-ray imaging system. Additionally, there is a need for methods and systems that control temperatures in an x-ray imaging system without needless additional costs. There is a need for temperature control methods and systems that improve operations for x-ray imaging systems as perceived by both the clinician and the patient.

BRIEF SUMMARY OF THE INVENTION

Certain embodiments of the present invention provide a system for controlling temperatures in an x-ray imaging environment including: a first component capable of operating within a first temperature range; a second component capable of operating within a second temperature range; and a liquid-based temperature control system capable of maintaining the first component within the first temperature range and maintaining the second component within the second temperature range. In an embodiment, the first component includes an x-ray detector. In an embodiment, the second component includes an x-ray source. In an embodiment, a liquid in the liquid-based temperature control system flows through the first component before flowing through the second component. In an embodiment, a heat exchanger in the liquid-based temperature control system can regulate a temperature of a liquid in the liquid-based temperature control system. In an embodiment, the heat exchanger includes at least one thermoelectric cooler device. In an embodiment, the heat extraction unit is configured to regulate temperature in response to information provided by a sensor. In an embodiment, the information includes a temperature of the liquid. In an embodiment, the system is substantially situated on a C-gantry. In an embodiment, the liquid-based temperature control system includes propylene glycol.

Certain embodiments of the present invention provide, in an x-ray imaging environment, a method for controlling temperatures including: regulating with a liquid a temperature of a first component within a first temperature range; regulating with the liquid a temperature of a second component within a second temperature range; and altering a temperature of the liquid in response to feedback information corresponding to the liquid. an embodiment, the first component includes a solid-state x-ray detector. In an embodiment, the second component includes an x-ray source. In an embodiment, the liquid flows through at least a portion of the first component before flowing through at least a portion of the second component. In an embodiment, the feedback information includes information about a temperature of the liquid. In an embodiment, the information about a temperature of the liquid is gathered before the liquid flows through at least a portion of the first component. In an embodiment, the altering a temperature of the liquid is performable with at least one thermoelectric cooler device.

Certain embodiments of the present invention provide, in a radiological imaging system having temperature sensitive components, a method for controlling temperatures including: gathering information from at least one component;

estimating an expected temperature for a first component and an expected temperature for a second component based at least in part on the information; and altering a temperature of a liquid in a liquid-based temperature control system to regulate the temperature of the first component within a first temperature range and the temperature of the second component within a second temperature range, based at least in part on at least one of: the expected temperature for the first component, and the expected temperature for the second component. In an embodiment, the first component includes a solid-state x-ray detector and the second component includes an x-ray source. In an embodiment, the liquid flows through at least a portion of the first component before flowing through at least a portion of the second component. In an embodiment, the information is gathered from at least a sensor capable of measuring a temperature of the liquid. In an embodiment, the sensor is positioned to measure the temperature of the liquid before the liquid flows through at least a portion of the first component. In an embodiment, the expected temperature of the first component is estimated by characterizing a thermodynamic response of the first component. In an embodiment, the expected temperature of the second component is estimated by characterizing a thermodynamic response of the second component.

Figure 1:
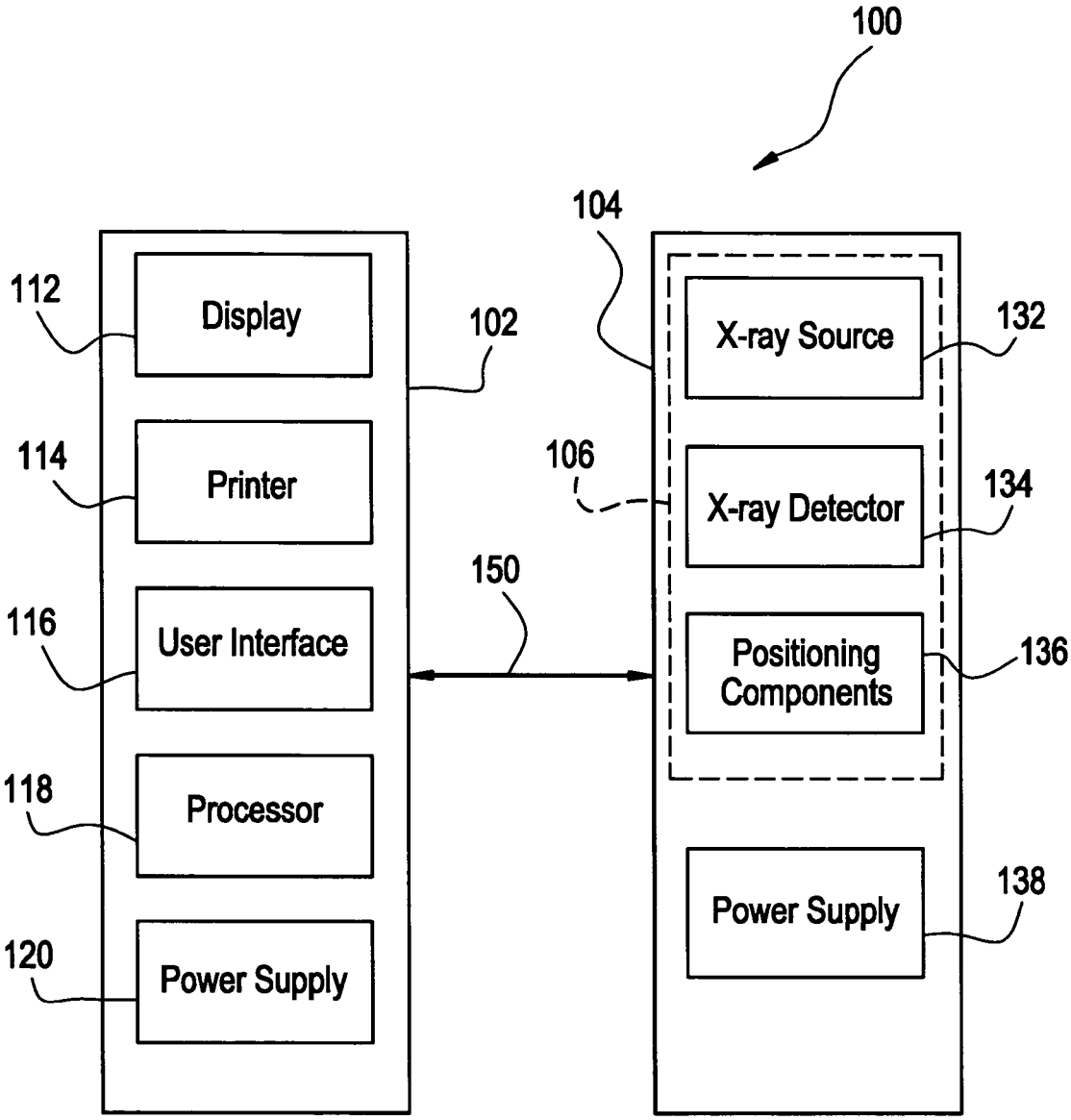
FIG. 1 shows an x-ray imaging system according to an embodiment of the present invention.

The foregoing summary, as well as the following detailed description of certain embodiments of the present application, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

FIG. 1 shows an x-ray imaging system 100 according to an embodiment of the present invention. An x-ray imaging system 100 includes components 102 and components 104. Components 102 and 104 may communicate through communication lines 150.

Components 102 include a display 112, printer 114, user interface 116, processor 118, and/or power supply 120. One or more of components 102 may be omitted, such as printer 114, for example. A display 112 may be any device capable of displaying x-ray image data generated by system 100. For example, display 112 may be a cathode ray tube, liquid crystal display, light emitting diode display, and/or the like. A printer 114 may be any device capable of generating an image that corresponds to x-ray image data. For example, a printer 114 may be an ink-jet, laser-jet, and/or dot-matrix printer. A user interface 116 may include a keyboard, mouse, and/or the like, for example. A processor 118 may include, for example, one or more central processing units (CPU). The processor 118 may be capable of controlling and receiving information from system components, such as components 102 and/or 104. A power supply 120 may be capable of providing power to components 102 and/or 104.

Components 104 include an x-ray source 132, x-ray detector 134, positioning components 136, and/or a power supply 138. Some of components 104 may be situated, at least in part, on a C-arm gantry 106, for example. For example, x-ray source 132, x-ray detector 134 and positioning components 136 may be situated at least in part on a C-arm gantry 106.

X-ray source 132 may include an x-ray tube. Because an x-ray source 132 may generate heat (e.g. due to production of heat energy as discussed), it may be necessary to prevent overheating of an x-ray source 132 after prolonged operation. For example, it may be necessary to shut off the x-ray source 132 if the temperature exceeds a certain temperature. As an example, a cutoff temperature may be 90° C.; however a cutoff temperature may vary based upon design of an x-ray source 132 (e.g. ability to radiantly cool itself) and/or design of the x-ray imaging system 100 (e.g. type of materials used in construction). An x-ray source 132 may draw a maximum power, such as 450 W, for example.

X-ray detector 134 may be a solid-state x-ray detector or amorphous silicon flat panel detector, for example. Prolonged operation of x-ray detector 134 may cause generation of heat, which may, in turn, cause the temperature of the x-ray detector 134 to rise. However, if the temperature of the x-ray detector 134 exceeds (or falls below) an efficient operating range, the performance of the x-ray detector 134 may deteriorate. For example, an x-ray detector 134 efficient operating temperature range may be between 25° and 35° C. An x-ray source 132 may draw a maximum power, such as 100 W, for example.

Positioning components 136 may include electro-mechanical devices capable of positioning x-ray source 132 and x-ray detector 134 along a c-arm gantry 106. For example, positioning components 136 may include motors, such as servo motors. Furthermore, a power supply 138 may be provided for providing, in particular, the high voltage power required for generation of x-rays by x-ray source 132, for example. Power supply 138 may also be adapted to supply power to other of components 104, such as x-ray detector 134 and positioning components 136. Power supply 138 may be integrated with power supply 120, or may be distributed across various other components and/or modules.

Figure 2:
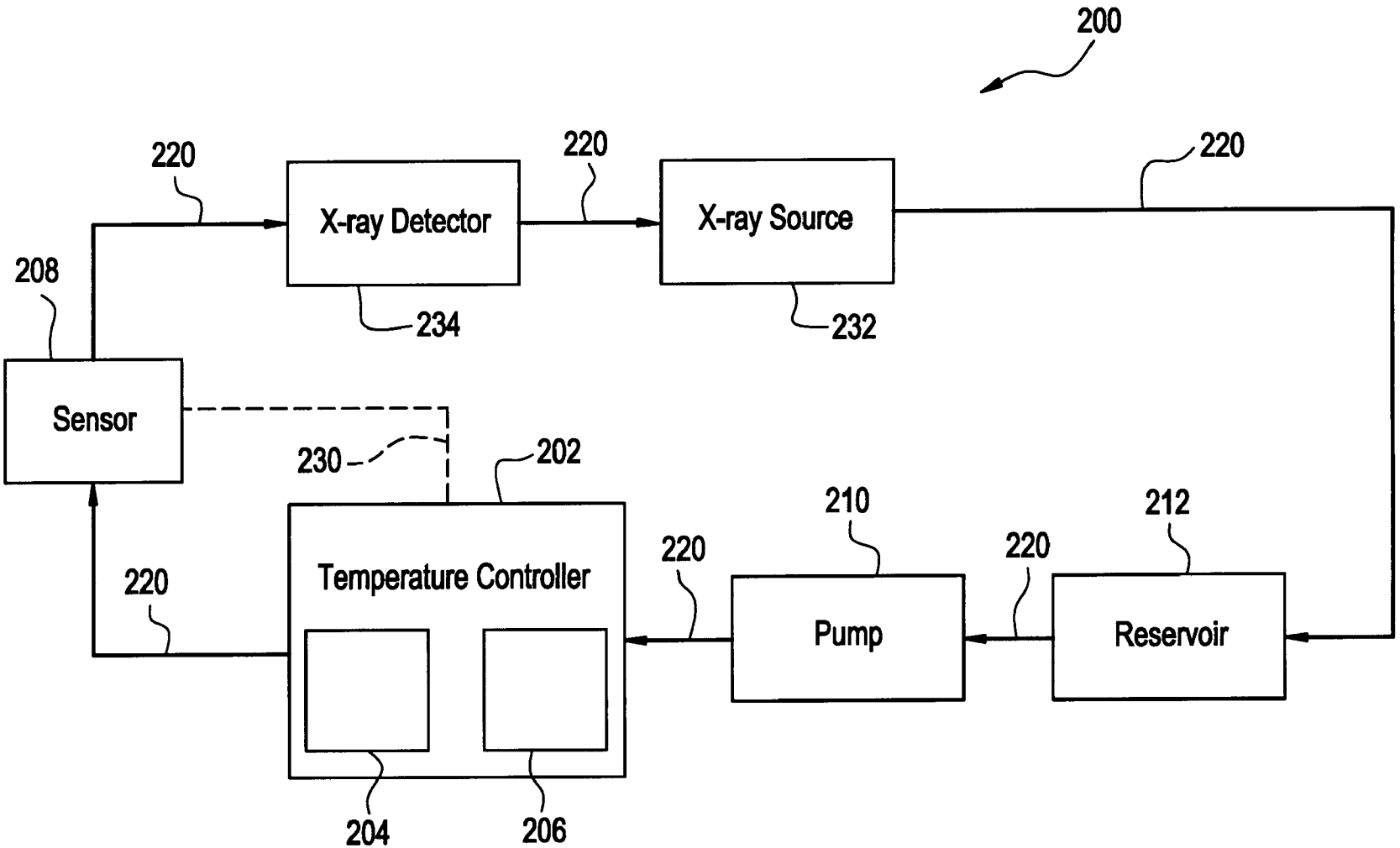
FIG. 2 shows a temperature control system for use in an x-ray imaging system in accordance with an embodiment of the present invention.

FIG. 2 shows a temperature control system 200 for use in an x-ray imaging system, such as x-ray imaging system 100, in accordance with an embodiment of the present invention. Temperature control system 200 may include x-ray source 232 (e.g., similar to x-ray source 132) and x-ray detector 234 (e.g., similar to x-ray detector 134). Temperature control system 200 may further include various components of a liquid-based cooling system, including a reservoir 212, pump 210, temperature controller 202, plumbing 220, a sensor 208, and electrical connection 230, for example. It may be possible to have substantially all of the components in temperature control system 200 situated on a L-arm, C-arm, C-gantry, and/or other positioning member such as C-gantry 106 (shown in FIG. 1).

A reservoir 212 may be suitable for storing an adequate amount of temperature regulating fluid (e.g. coolant) and/or other liquids/fluids necessary for proper operation of control system 200. For example, a temperature regulating fluid (e.g. coolant) may be a mix of water and propylene glycol. Various other possibilities for temperature regulating fluid (e.g. coolant) may also be possible. Reservoir 212 may be configured such that fluids may be easily stored and retrieved. Further, a reservoir 212 may have level sensor(s) capable of communicating fluid level information to any of a variety of components, such as temperature controller 202.

A pump 210 may be suitable for driving an adequate amount of temperature regulating fluid (e.g. coolant) through control system 200. A pump 210 may be any of a variety of styles, such as a centrifugal magnetic drive pump, or a positive displacement pump. A pump 210 may be controllable by temperature controller 202, and/or by other sources, for example. A pump 210 may be capable of sustaining a sufficient pressure to cause fluid to flow through system 200 at a relatively constant flow, for example. For example, pump 210 may be capable of driving a temperature regulating fluid (e.g. coolant) through system 200 at a rate of approximately at least one liter/minute. If preferred, a pump 210 may be capable of producing a variable and/or intermittent flow of fluid through system 200.

A temperature controller 202 may further include a heat exchanger 204 and a processor 206. The temperature controller 202 may be capable of receiving and/or sending signals to/from any of a variety of components, such as sensor 208, pump 210, and reservoir 212. The temperature controller 202 may also be capable of receiving and/or sending signals to a source external to system 200, such as processor 118, for example. The temperature controller 202 may be an integrated component, or may be distributed across two or more sub-components, for example. A temperature controller 202 may be supplied power by any appropriate power supply, such as power supply 138 and/or power supply 120, for example. Further, temperature controller 202 may have its own localized power supply, such as a low voltage DC power supply, for example.

A heat exchanger 204 may further be included in a temperature controller 202. A heat exchanger 204 may be any device(s) suitable for transfering thermal energy from one fluid to another, whether the fluids are separated by a solid wall so that they never mix, or the fluids are directly contacted, for example. A heat exchanger 204 may be any of a variety of types, such as a shell and tube heat exchanger, a plate heat exchanger, a radiator, a parallel-flow exchanger, a cross-flow exchanger, a counter-flow exchanger, a recuperative-type exchanger, a regenerative-type exchanger, and/or an evaporation-type exchanger, for example. A heat exchanger 204 may include refrigerant and/or a compressor, for example. In an embodiment, a heat exchanger 204 may be formed from one or more thermoelectric cooling chips ("TECs"). One advantage of TECs is that energy may be either added to, or removed from the temperature regulating fluid (e.g. coolant) fluid, depending on a mode of operation. A TEC may be a chip that exploits the peltier effect to transfer energy to/from fluids, for example. A TEC may also be a solid-state, low-profile device that may not require refrigerant, for example. TECs may be arranged to drain off unwanted moisture, such as condensation, through a drip pan, for example. A TEC may be arranged in proximity of a heat sink, such that acquired thermal energy from the fluid may be transferable to a second fluid, such as air, for example. The temperature regulating fluid (e.g. coolant) may flow proximally to a heat exchanger 204—either coming into direct contact with the heat exchanger 204 or just passing nearby. The heat exchanger 204 may have a lower or higher temperature than the temperature regulating fluid (e.g. coolant). Due to the temperature gradient between the fluid and the heat exchanger 204, thermal energy may flow between the fluid and the heat exchanger 204. For example, the temperature of the fluid may be reduced after flowing proximally to the heat exchanger 204. A heat exchanger 204, such as TECs for example, may be controllable through a processor 206 (or processor 118, for example) and associated circuitry, for example. The system 200 may be configured to maintain the temperature regulating fluid (e.g. coolant) at a temperature below approximately 40 degrees C., for example. A maximum temperature regulating fluid (e.g. coolant) temperature may correspond to maximum heat loads of the system 200, for example.

A processor 206 may also be included in a temperature controller 202. The processor 206 may include one or more processors, such as a central processing unit, a digital signal processor, a microcontroller, a microprocessor, and/or the like. The processor 206 may also include associated circuitry. The processor 206 may be capable of receiving and/or sending signals from/to a variety of components, such as sensor 208, pump 210, and reservoir 212, and/or other sources, for example. The processor 206 may be able to receive temperature information from sensor 208, for example. Further the processor 206 may be able to control certain aspects of a fluid in response to received information. For example, the processor 206 may be able to control temperature of the fluid by controlling a heat exchanger 204. As another example, the processor 206 may be able to control fluid speed in response to received information from, for example, the reservoir. For example, the processor 206 may be capable of controlling pump 210 in response to received information. The processor 206 may also be able to control x-ray detector 234 and/or x-ray source 232. For example, processor 206 may be able to cease operation in either the x-ray detector 234 and/or x-ray source in response to received information Plumbing 220 may also be included in system 200. Plumbing 220 may be any apparatus (such as pipes, tubing, valves, drains, fixtures, etc.) involved in the distribution, use, and conveyance of fluids, such as a temperature regulating fluid (e.g. coolant). Plumbing 220 may be suitable for containing a preferred temperature regulating fluid (e.g. coolant), such as a mix of water and propylene glycol. Plumbing 220 may be arranged to circulate a fluid, such as a temperature regulating fluid (e.g. coolant), through system 200 to control temperature in temperature-sensitive components, such as x-ray detector 234 and x-ray source 232. Plumbing 220 may be suitable to operate throughout a range of temperatures, such as, for example 0–50 degrees C. Some portions of plumbing 220 may be rated at higher or lower tolerances, depending on the expected operating conditions. For example, portions of plumbing 220 that are routed through heat-generating components, such as x-ray source 232, may be rated to operate at higher temperatures, than, for example, portions of plumbing operating at ambient, room-temperature environments.

Sensor 208 may be able to ascertain certain information about a fluid flowing through system 200, such as a temperature regulating fluid (e.g. coolant). For example, sensor 208 may be able to ascertain a temperature of a fluid, or a fluid motion speed. Sensor 208 may be located anywhere in system 200. In an embodiment, sensor 208 is located downstream from temperature controller 202, but upstream from a temperature-sensitive component, such as x-ray detector 234. In this way, sensor 208 may provide information about the temperature of a fluid as it leaves the temperature controller, for example. Of course, sensor 208 may be located in other locations, such as downstream from the x-ray source 232, but upstream from the temperature controller. Sensor 208 may be a thermocouple, a resistive sensor, a capacitive sensor, and/or the like. Sensor 208 may be an active sensor (requiring power), or may be a passive sensor (such as a thermocouple). Sensor may be able to communicate information with temperature controller 202, through for example an electrical connection 230. Other types of connections, such as wireless, optical, and/or infrared may also be possible. The feedback of information from a sensor 208 to temperature controller 202 through, for example, an electrical connection 230 may create a closed loop temperature control system.

X-ray detector 234 may be, in many respects, similar to x-ray detector 134. X-ray detector 234 may further include apparatus suitable for transferring thermal energy to/from a fluid, such as a temperature regulating fluid (e.g. coolant) flowing through plumbing 220. For example, x-ray detector 234 may include a heat exchanger, such as a heat sink.

Figure 5:
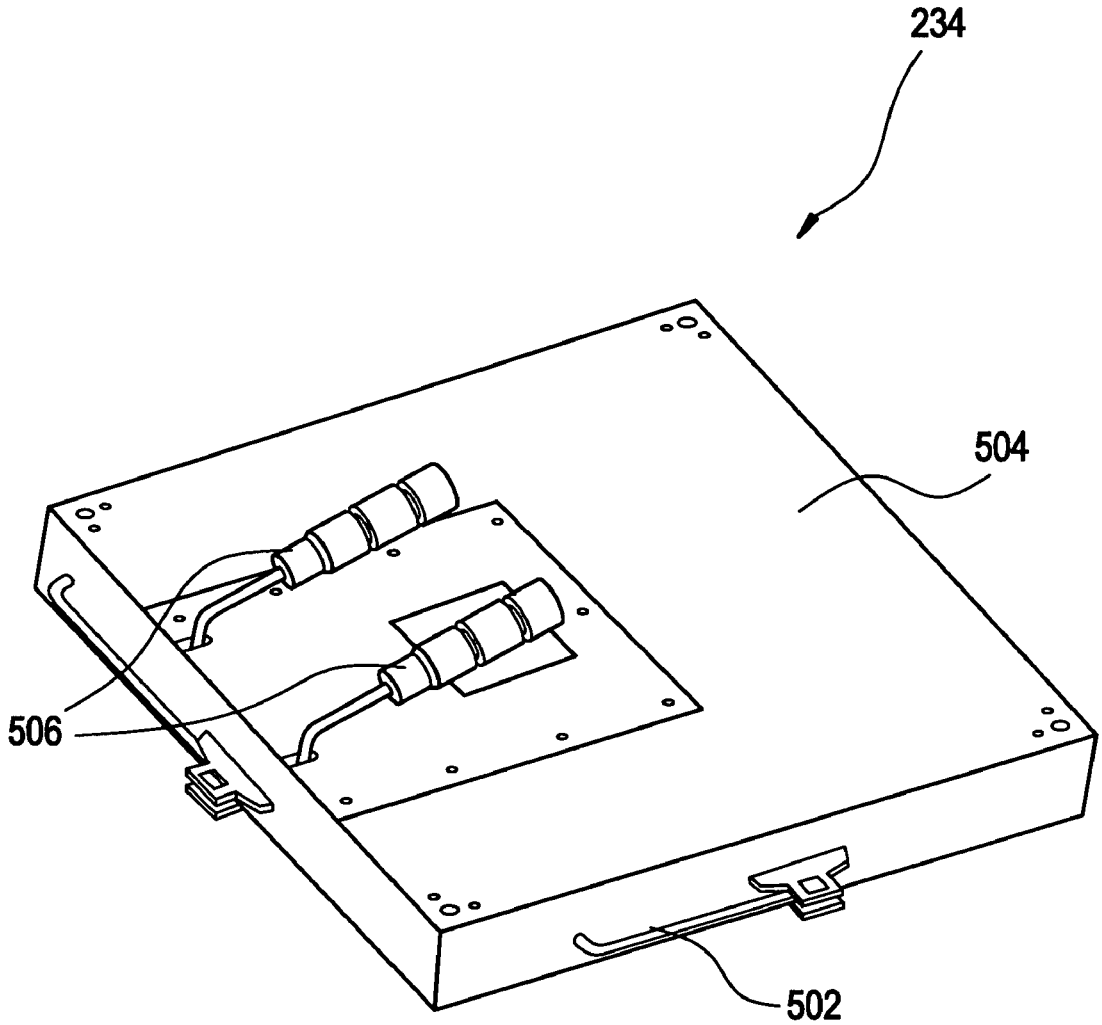
FIG. 5 shows an x-ray detector configured for use with a liquid-based cooling system, in accordance with an embodiment of the present invention.

Turning for a moment to FIG. 5, an x-ray detector 234 is shown configured for use with a liquid-based cooling system (such as system 200), in accordance with an embodiment of the present invention. The detector 234 may include heat-generating components 502, such as scintillator(s), absorptive materials, power regulators, power semiconductors, and/or the like. Further, the detector 234 may include a heat exchanger 504, such as a cold plate. The heat exchanger 504 may include flow paths for a temperature regulating liquid, for example. The delivery of the temperature regulating liquid (e.g. coolant) to the heat exchanger 504 may be facilitated through inflow and outflow ports 506. In such a configuration, thermal energy may be added or removed to/from the x-ray detector 234 through a temperature regulating liquid (e.g. coolant), for example.

Turning back to FIG. 2, x-ray detector 234 may also be capable of communicating information with another component, such as temperature controller 202. For example, x-ray detector 234 may contain temperature sensors that communicate temperature information with temperature controller 202. Further, x-ray detector 234 may be capable of receiving information, such as a message to shut down or to operate in reduced power mode, from other components, such as temperature controller 202.

X-ray source 232 may be, in many respects, similar to x-ray source 132. X-ray source 232 may further include apparatus suitable for transferring thermal energy to/from a fluid, such as a temperature regulating fluid (e.g. coolant) flowing through plumbing 220. For example, x-ray source 232 may include a heat exchanger, such as a heat sink. Further, x-ray source 232 may be capable of receiving information, such as a message to shut down or to operate in reduced power mode, from other components, such as temperature controller 202.

Figure 7:
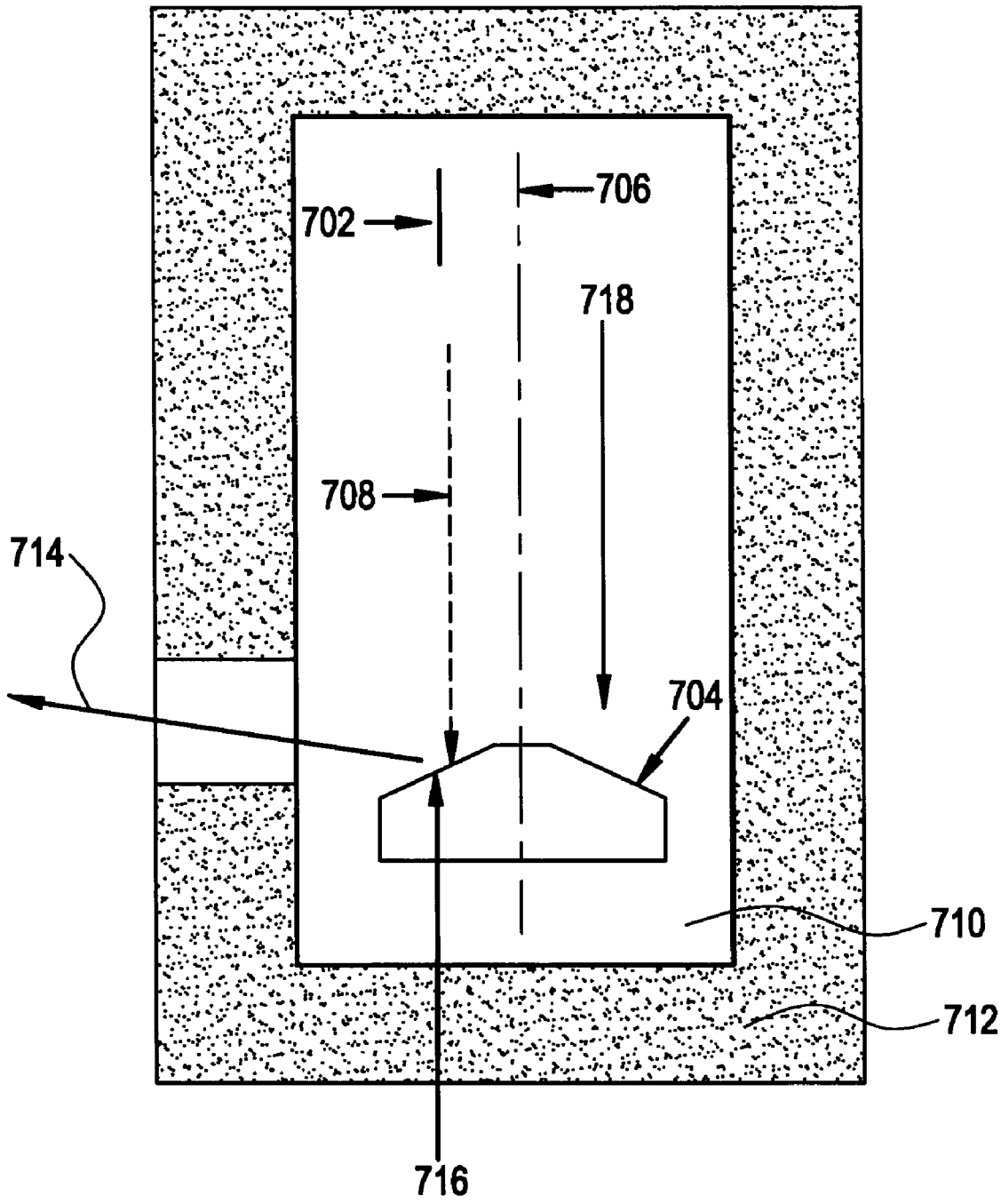

Turning to FIG. 7, an x-ray tube 700 is shown, in accordance with an embodiment of the present invention. An x-ray tube 700 may include a cathode 702 for producing an electron beam 708 along a direction of an electric field 718, for example. The electron beam may strike an anode 704, for example. The anode may rotate along an axis 706, for example. The location 716 at which the electron beam strikes the anode may emit x-ray energy 714 and/or other energy, such as heat, for example. Such generated heat may be conducted through a fluid 710, such as oil, for example. The heat may further be conducted through a housing 712, such as an aluminum housing, for example.

Figure 6:
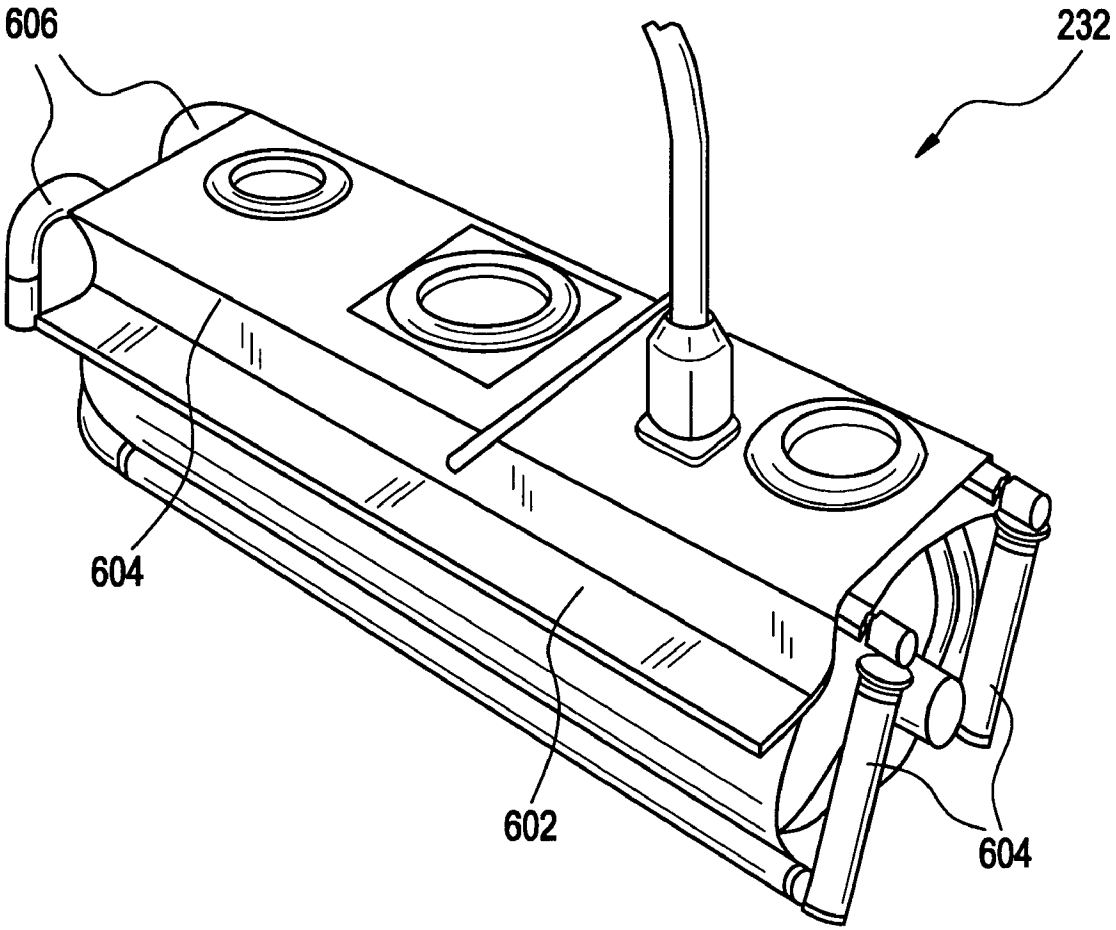
FIGS. 6 and 7 shows an x-ray source configured for use with a liquid-based cooling system, in accordance with an embodiment of the present invention.

Turning to FIG. 6, an x-ray source 232 configured for use with a liquid-based cooling system (such as system 200) is shown, in accordance with an embodiment of the present invention. The x-ray source 232 may include heat-generating components 602, such as an x-ray tube (e.g. tube 700) and/or power generation/regulation components. The heat generating components 602 may be at least partially surrounded by a jacket containing a temperature regulating fluid (e.g. coolant). The temperature regulating fluid may flow through temperature regulating fluid (e.g. coolant) lines 604 that may be integrated into the jacket, for example. The temperature regulating fluid may be delivered to the x-ray source 232 through inflow and outflow ports 606, for example. Thermal energy may be delivered/removed to/form the x-ray source 232 through the temperature regulating fluid.

Figure 3:
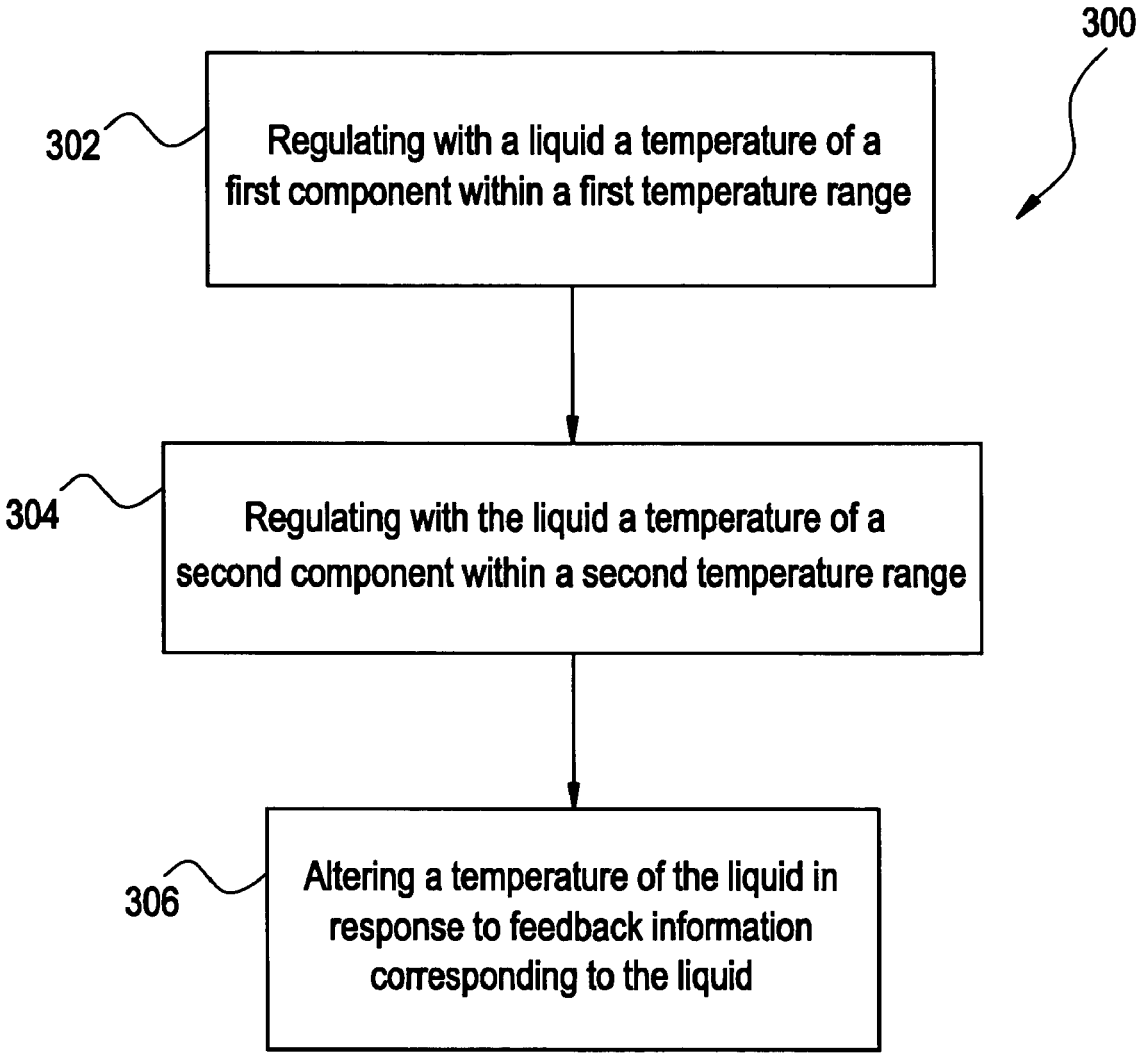
FIG. 3 shows a flowchart of a method for controlling temperature in an x-ray imaging system in accordance with an embodiment of the present invention.

FIG. 3 shows a flowchart of a method 300 for controlling temperature in an x-ray imaging system in accordance with an embodiment of the present invention. The steps of method 300 may be performable in an alternate order, or some steps may be omitted. Further, the steps of method 300 may be performable, at least in part, by a processor that includes a computer-readable medium.

At step 302 a temperature of a first component may be regulated with a liquid. The temperature of the first component may be regulated within a first temperature range. For example, the first component may be an x-ray detector, such as x-ray detector 234. The liquid may be provided through plumbing 220 of a temperature control system 200. The liquid may be a temperature regulating fluid (e.g. coolant), such as a mix of water and propylene glycol, for example. The first component may have a heat exchanger (e.g. heat exchanger 504 shown in FIG. 5) capable of facilitating thermal energy transfer between the liquid and the first component. The first component may be a temperature-sensitive component, such as x-ray detector 234, for example. A temperature on, in, or near the first component may be regulated within a first temperature range. For example, with a solid-state x-ray detector 234, it may be preferable to regulate the temperature of heat generating and/or heat sensitive components within a particular temperature range, such as between 25 and 35 degrees centigrade. It may be that, given ambient conditions (e.g. room temperatures), a temperature may be regulated without active control. For example, if a low boundary of a temperature range is 25 degrees centigrade, and the room in which an x-ray imaging system is situated is maintained at 26 degrees centigrade, then the temperature may be regulated above the low boundary based on ambient conditions.

There are a variety of ways to regulate a temperature of the first component within a first temperature range with a liquid. For example, temperature information within the first component may be communicated to a temperature controller 202, and the controller 202 may alter the temperature of the liquid in response. As another example, the thermodynamic response of the first component may be characterized in advance. The temperature controller 202 may be able to adjust the temperature of the liquid such that the expected thermodynamic response of the first component will fall within an acceptable temperature range for efficient performance. Temperature controller 202 may also take into account other variables, such as liquid speed, ambient temperature (e.g. room temperature), other component temperatures, and/or the like when adjusting the temperature of the liquid in system 200.

At step 304 a temperature of a second component may be regulated with a liquid. The temperature of the second component may be regulated within a second temperature range, for example. For example, the second component may be an x-ray source, such as x-ray source 232. The liquid may be provided through plumbing 220 of a temperature control system 200. The liquid may be a temperature regulating fluid (e.g. coolant), such as a mix of water and propylene glycol, for example. The second component may have a heat exchanger (e.g. a jacket containing a temperature regulating fluid) capable of facilitating thermal energy transfer between the liquid and the first component. The second component may be a temperature-sensitive component, such as x-ray source 232, for example. A temperature on, in, or near the second component may be regulated within a second temperature range, for example. For example, with a x-ray source 232, it may be preferable to keep the temperature of the x-ray tube within a particular temperature range, such as between 15 and 90 degrees Centigrade. It may be that, given ambient conditions (e.g. room temperatures), the low boundary of a particular temperature range may be regulated without active control. For example, if a low boundary of a temperature range is 15 degrees centigrade, and the room in which an x-ray imaging system is situated is maintained at 30 degrees centigrade, then the temperature may be regulated above the low boundary based on ambient conditions.

There are a variety of ways to regulate a temperature of the second component within a second temperature range with a liquid. For example, temperature information within the second component may be communicated to a temperature controller 202, and the controller 202 may alter the temperature of the liquid in response. As another example, the thermodynamic response of the second component may be characterized in advance. Then, the temperature controller 202 may be able to adjust the temperature of the liquid such that the expected thermodynamic response of the second component will fall within an acceptable temperature range for efficient performance. Temperature controller 202 may also take into account other variables, such as liquid speed, ambient temperature (e.g. room temperature), other component temperatures, and/or the like when adjusting the temperature of the liquid in system 200.

In an embodiment, the first temperature range is more precise (e.g. narrower) than the second temperature range. For example, the first temperature range may only be ten degrees centigrade, whereas the second temperature range may be over fifty degrees centigrade. If this is the circumstance, it may be efficient to control the temperature of the first component before controlling the temperature of the second component. After controlling the temperature of the first component, the fluid in the plumbing 220 of system 200 may have an altered temperature, due to thermal exchange at the first component. It may be possible to measure the temperature of the fluid after flowing through the first component with, for example a sensor, such as sensor 208. It may, however, not be necessary to provide this additional sensor. For example, if the second temperature range is broad enough, it may be acceptable for the temperature of the fluid entering the second component to have an associated uncertainty. In other words, it may be acceptable to not precisely know the temperature of the fluid before it enters the second component. For example, a fluid entering the second component may be anywhere in the range of 25 to 35 degrees centigrade after leaving the first component, based on characterized thermal response of the system 200. This range of fluid temperatures may be sufficient to keep the second component operating within the second temperature range.

At step 306, a temperature of the liquid may be altered in response to feedback information corresponding, at least in part, to the liquid. Temperature of the liquid may be controlled through, for example, a temperature controller 202. Feedback information may be provided by, for example, sensor 208. As discussed, sensor 208 may be situated anywhere in system 200. In an embodiment, sensor 208 is located between temperature controller 202 and x-ray detector 234. Furthermore, multiple sensors 208 may also be provided at a variety of locations in system 200. The temperature may be altered in response to other types of information as well. For example, the temperature of the liquid may be altered in response to the temperature of the first component, second component, ambient temperature (e.g. room temperature), and/or the like. Furthermore, temperature of the liquid may be altered in response to other information, such as fluid speed, pump speed, humidity levels, reservoir levels, and/or the like.

As an illustrative example, method 300 may be performed in the following manner. A temperature control system 200 is provided in conjunction with an x-ray detector 234 and an x-ray source 232. The temperature control system 200 employs a liquid for controlling various temperatures in the system 200 and associated components. The system is arranged such that the fluid flows from a reservoir 212, through a pump 210, and into a temperature controller 202, where the temperature of the fluid is adjusted in response to various information, including feedback information. The fluid further flows through sensor 208, and then through an x-ray detector 234 and subsequently through an x-ray source 232. Finally, the fluid flows back into the reservoir, thus completing one cycle of the temperature control system 200 loop.

At step 302, the liquid flows into the first component, which is, in this example, the x-ray detector 234. The x-ray detector 234 has an efficient operating range between 25 and 35 degrees centigrade, for example. This range—25 to 35 degrees centigrade—corresponds to the first temperature range. The x-ray detector 234 generates heat through use. In order to diffuse the heat, a liquid-based heat exchanger (e.g. cold plate) is positioned in proximity to the temperature sensitive and/or heat generating components. As the liquid flows through the heat exchanger, thermal energy is transferred from the x-ray detector 234 to the liquid. The transfer of energy between the detector 234 and the liquid causes the temperature of the detector 234 to be regulated within the first temperature range. Before entering the first component, the liquid is approximately 25 degrees centigrade, for example. After leaving the first component, the liquid may be anywhere from 25 to 35 degrees centigrade, depending on the amount of heat transfer from the x-ray detector 234.

At step 304, the liquid flows into the first component, which is, in this example, the x-ray source 232. The x-ray source 232 has an efficient operating range between 15 and 90 degrees centigrade, for example. This range—15 to 90 degrees centigrade—corresponds to the second temperature range. The x-ray source 232 generates heat through use. Heat emanates from the x-ray tube. A jacket encloses the tube, and the jacket allows a temperature regulating liquid to pass through. As the liquid flows through the jacket, thermal energy is transferred from the x-ray source 232 to the liquid. The transfer of energy between the source 232 and the liquid causes the temperature of the source 232 to be regulated within the second temperature range. Although the liquid does not have a precisely identifiable temperature before entering the second component, it is within the range of 25 to 35 degrees centigrade, for example, depending on the amount of heat transfer from the x-ray detector 234. A liquid within this range is sufficient to regulate the operating temperature of the x-ray source 232 within the second temperature range.

At step 306, the temperature of the liquid is altered in response to feedback information corresponding to the liquid. A sensor 208 provides the feedback information in this example. The sensor 208 is a passive thermocouple that monitors the temperature of the liquid before it enters the first component (x-ray detector 234 in this example). The processor 206 of the temperature controller 202 monitors data from the thermocouple. In response to the measured temperature of the liquid, the processor 206 controls the operation of the heat exchanger 204. In this example, the heat exchanger 204 includes a plurality of TECs. The processor 206 controls the TECs by selective switching, enabling, biasing, and/or the like, for example. If the measured temperature of the liquid is increasing, the processor 206 can increase the cooling of the liquid by controlling the heat exchanger 204 in an appropriate manner. Similarly, the processor 206 can ramp down the cooling of the liquid through appropriate control over the heat exchanger 204.

Figure 4:
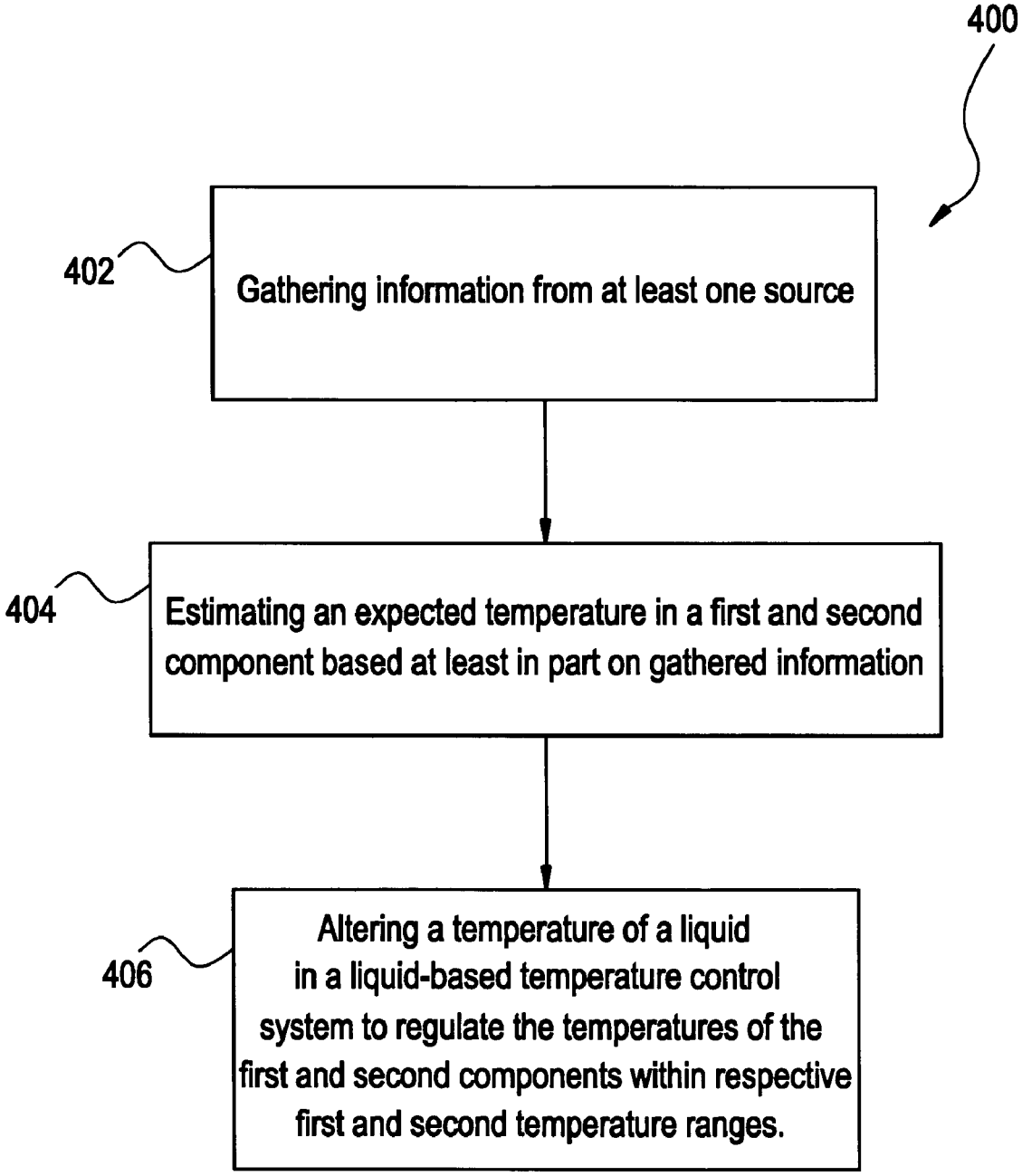
FIG. 4 shows a flowchart of a method for controlling temperature in an x-ray imaging system in accordance with an embodiment of the present invention.

FIG. 4 shows a flowchart of a method 400 for controlling temperature in an x-ray imaging system in accordance with an embodiment of the present invention. The steps of method 400 may be performable in an alternate order, or some steps may be omitted. Further, the steps of method 400 may be performable, at least in part, by a computer or other processor executing instructions on a computer-readable medium, for example.

At step 402 information is gathered from at least one source. For example, a source may be a sensor, such as sensor 208. Such a sensor may be able to measure the temperature of the liquid as it flows through various portions of a liquid-based control system, such as system 200. For example, sensor 208 may be positioned to measure the liquid temperature after it leaves the temperature controller 202, but before entering a first temperature sensitive component, such as x-ray detector 234. Other information may also be gathered at step 402. For example, information may be gathered regarding temperatures at various components, such as an x-ray detector 234 and x-ray source 232. As another example, information may be gathered regarding duty cycles, periods of operation, and power levels of various components, such as x-ray detector 234 and x-ray source 232. Such information may come from sources external to a liquid-based cooling system, such as processor 118, for example. Furthermore, information may be gathered indicating the liquid temperature and/or speed as it flows through other portions of a liquid-based temperature control system. Information may also be gathered corresponding to other components, such as a pump 210, reservoir 212, temperature controller 202, and/or plumbing 220. Information may also be gathered corresponding to ambient temperatures (e.g. room temperature), humidity, and/or the like. Information may be gathered from sources through electronic communications, or through wireless, optical, infrared communications, and/or the like.

At step 404 expected temperatures are estimated in a first and second component based at least in part on gathered information. A first and second component may be an x-ray detector 234 and an x-ray source 232, for example. Other possibilities also abound. For example, a first and/or second component may be any temperature sensitive component in an x-ray imaging system, such as a power supply, or electromechanical components. Expected temperatures in the first and second components may be estimated based on a variety of information. For example, temperature information corresponding to internal temperatures in various components may serve as a basis for estimation. Other information includes, but is not limited to: ambient temperatures; duty cycles of the components; power levels of the components; period of operation of the components; humidity; and/or any information corresponding to a liquid-based cooling system, for example. Furthermore, temperatures may be estimated based on characterized thermodynamic responses of various components, such as an x-ray detector 234 and an x-ray source 232. For example, a thermodynamic response of an x-ray source 232 may be characterizable based on a variety of variables such as period of operation, duty cycle, and power level. If some or all of these variables are known, temperatures within the x-ray source 232 may be estimated, for example.

At step 406, a temperature of a liquid is altered in a liquid-based temperature control system to regulate the temperatures of the first and second components within respective first and second temperature ranges. Temperature of the liquid may be controlled through, for example, a temperature controller 202. The temperature may be altered in response to any of the variety of information from step 402 and/or estimations in step 404. For example, the temperature of the liquid may be altered in response to the temperature of the first component, second component, ambient temperature (e.g. room temperature), and/or the like. Furthermore, temperature of the liquid may be altered in response to other information, such as fluid speed, pump speed, humidity levels, reservoir levels, and/or the like.

Thus, embodiments of the present application provide methods and systems that control temperatures in a plurality of temperature-sensitive components in an x-ray imaging system. Additionally, embodiments of the present application provide methods and systems that control temperatures in an x-ray imaging system without needless additional costs. Moreover, embodiments of the present application provide temperature control methods and systems that improve operations for x-ray imaging systems as perceived by both the clinician and the patient.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. For example, features may be implemented with software, hardware, or a mix thereof. Therefore, it is intended that the invention not be limited to the particular embodiment disclosed, but that the invention will include all embodiments falling within the scope of the appended claims.

The invention claimed is:

1. A system for controlling temperatures in an x-ray imaging environment comprising:

a first component operating within a first temperature range;

a second component operating within a second temperature range;

a sensor providing information corresponding to a temperature of a liquid; and a liquid-based temperature control system maintaining said first component within said first temperature range and maintaining said second component within said second temperature range, based at least in part on said information corresponding to said temperature of said liquid.

2. The system of claim 1, wherein said first component comprises an x-ray detector.

3. The system of claim 1, wherein said second component comprises an x-ray source.

4. The system of claim 1, wherein a liquid in said liquid-based temperature control system flows through said first component before flowing through said second component.

5. The system of claim 1, wherein a heat exchanger in said liquid-based temperature control system can regulate a temperature of a liquid in said liquid-based temperature control system.

6. The system of claim 5, wherein said heat exchanger comprises at least one thermoelectric cooler device.

7. The system of claim 5, wherein said heat extraction unit is configured to regulate temperature in response to said information provided by said sensor.

8. The system of claim 1, wherein said system is substantially situated on a C-gantry.

9. The system of claim 1, wherein said liquid-based temperature control system includes propylene glycol.

10. In an x-ray imaging environment, a method for controlling temperatures comprising:

regulating with a liquid a temperature of a first component within a first temperature range;

regulating with said liquid a temperature of a second component within a second temperature range; and altering a temperature of said liquid in response to feedback information corresponding to information corresponding to a temperature of said liquid.

11. The method of claim 10, wherein said first component comprises a solid-state x-ray detector.

12. The method of claim 10, wherein said second component comprises an x-ray source.

13. The method of claim 10, wherein said liquid flows through at least a portion of said first component before flowing through at least a portion of said second component.

14. The method of claim 10, wherein said information about a temperature of said liquid is gathered before said liquid flows through at least a portion of said first component.

15. The method of claim 10, wherein said altering a temperature of said liquid is performable with at least one thermoelectric cooler device.

16. In a radiological imaging system having temperature sensitive components, a method for controlling temperatures comprising:

gathering information from a sensor measuring the temperature of a liquid;

estimating an expected temperature for a first component and an expected temperature for a second component based at least in part on said information; and altering a temperature of said liquid in a liquid-based temperature control system to regulate said temperature of said first component within a first temperature range and said temperature of said second component within a second temperature range, based at least in part on at least one of: said expected temperature for said first component, and said expected temperature for said second component.

17. The method of claim 16, wherein said first component comprises a solid-state x-ray detector and said second component comprises an x-ray source.

18. The method of claim 16, wherein said liquid flows through at least a portion of said first component before flowing through at least a portion of said second component.

19. The method of claim 16, wherein said sensor is positioned to measure said temperature of said liquid before said liquid flows through at least a portion of said first component.

20. The method of claim 16, wherein said expected temperature of said first component is estimated by characterizing a thermodynamic response of said first component.

21. The method of claim 16, wherein said expected temperature of said second component is estimated by characterizing a thermodynamic response of said second component.

22. In an x-ray imaging environment, a method for controlling temperatures comprising:

regulating with a liquid a temperature of a first component within a first temperature range;

regulating with said liquid a temperature of a second component within a second temperature range; and altering a temperature of said liquid in response to feedback information corresponding to said liquid, wherein said feedback information comprises information about a temperature of said liquid, and wherein said information about a temperature of said liquid is gathered before said liquid flows through at least a portion of said first component.

23. In a radiological imaging system having temperature sensitive components, a method for controlling temperatures comprising:

gathering information from at least one component;

estimating an expected temperature for a first component and an expected temperature for a second component based at least in part on said information; and altering a temperature of a liquid in a liquid-based temperature control system to regulate said temperature of said first component within a first temperature range and said temperature of said second component within a second temperature range, based at least in part on at least one of: said expected temperature for said first component, and said expected temperature for said second component, wherein said information is gathered from at least a sensor capable of measuring a temperature of said liquid, and wherein said sensor is positioned to measure said temperature of said liquid before said liquid flows through at least a portion of said first component.

* * * * *